US006088983A

United States Patent [19]

Applebee

[11] Patent Number: 6,088,983

[45] Date of Patent: Jul. 18, 2000

[54] ROOF PANEL AND ROOF PANEL SYSTEM

[76] Inventor: Michael L. Applebee, 1449 NE. 25th Ave., Hillsboro, Oreg. 97124

[21] Appl. No.: 09/291,821

[22] Filed: Apr. 14, 1999

[51] Int. Cl.[7] ..... E04D 1/30; E04D 3/30; E04D 3/362

[52] U.S. Cl. ..... 52/282.1; 52/462; 52/464; 52/468; 52/472; 52/528; 52/536; 52/551; 52/588.1; 52/715; 52/748.1

[58] Field of Search ..... 52/519, 521, 528, 52/539, 551, 462, 748.1, 715, 282.1, 281, 588.1, 536, 464, 472, 468

[56] References Cited

U.S. PATENT DOCUMENTS

| | | | |
|---|---|---|---|
| 3,852,933 | 12/1974 | Guzzo | 52/533 |
| 4,014,152 | 3/1977 | Vallee . | |
| 4,106,250 | 8/1978 | Cummings et al. . | |
| 4,168,596 | 9/1979 | Yoder, Jr. | 52/462 |
| 4,497,151 | 2/1985 | Simpson et al. . | |
| 4,597,234 | 7/1986 | Simpson . | |
| 4,700,522 | 10/1987 | Simpson . | |
| 4,841,701 | 6/1989 | Sukup | 52/748.1 X |
| 5,012,623 | 5/1991 | Taylor . | |
| 5,737,881 | 4/1998 | Stocksieker . | |
| 5,881,501 | 3/1999 | Guffey et al. . | |

*Primary Examiner*—Christopher T. Kent
*Attorney, Agent, or Firm*—Keith A. Cushing

[57] ABSTRACT

Elongate metal roof panels with interlocking edge formations combine to establish a roof system. A center panel having matching edge locking formations and positioned at a mid-point on a planar roof section couples to a first series of elongate metal roof panels extending leftward and couples to a second series of elongate metal roof panels extending laterally rightward. Members of the first and second series of panels are similar in structure and include complimentary locking edge structures, but couple in opposite orientation.

17 Claims, 4 Drawing Sheets

ROOF PANEL AND ROOF PANEL SYSTEM

BACKGROUND OF THE INVENTION

Metal panels provide good roofs, but cannot be applied as large sections of a roof due to temperature related buckling, distribution of fasteners, and wind-lift issues. Many attempts to use large-area metal panels have failed for these reasons. Long narrow roof panels, however, have proven successful. A roof structure results by placing a series of elongate narrow panels side-by-side in overlapping and interlocking relation across a roof substrate.

Thus, metal roof panels are from one to one and one-half feet wide and extend vertically along the roof from gutter line to ridge. The depth of panels is typically one to three inches as provided by bending formations for rigidity and by interlocking structures. Each panel has complimentary interlocking structures along its edges. A left edge of a first panel interlocks with an overlapping right edge of a second adjacent panel. A variety of particular configurations and interlocking structures have developed, but the basic method of use is by complimentary interlocking structures along the edges of each elongate roof panel.

In a typical configuration, each panel includes a female structure and a complimentary male structure along respective edges of the elongate panel. At the outermost edge and adjacent the female structure, a series of apertures allow attachment by fasteners therethrough to a roof substrate. This ties-down the "female" side of each panel. The male structure of an adjacent second panel couples, i.e., interlocks by virtue of the complimentary relation to the female structure, to the female structure of the previous panel in the series. This ties-down the "male" side of each panel. Each panel at its "male" side covers the fasteners along the "female" side of the previous panel in the series. Thus, while each panel attaches directly to the roof substrate only at one edge, the other edge interlocks to a previous panel along the fastened edge of that previous panel.

In applying such roofing panels, a worker lays down at one extreme edge of the roof, e.g., the left-most edge, a roof panel and screws it in place including attachment along its right edge. The next panel then lays upon and interlocks at its left edge with the right edge of the first panel. One person works a given planar roof section at a time because, at any given time, there is only one "working edge" available to receive a next panel in the series of panels. The process continues in series until a given section of roof is traversed sideways, e.g., left to right.

A particular problem arises in hip roof applications. More particularly, a hip roof includes four or more planar regions. For each planar region, the outside portions taper in length, i.e., progressively shorter distance between ridge line and gutter line as one approaches the outer-most edges. In applying the metal roof panels as described above, one begins at the left-most edge of a given planar section and works across the roof section. The first panel attached is the shortest panel of the series of panels for that section of roof. One must carefully align this first and very short roof panel as this first panel sets the orientation, i.e., vertical alignment, for all remaining panels across this section of roof. Despite best efforts, many panels are not properly aligned due to small errors at the beginning of the process, i.e., the initial short length panel was crooked, and such errors propagate across the entire planar roof section. Sometimes this results in an unacceptable appearance and requires removal and re-application of roof panels. Such removal often results in damage or sometimes destruction of the roof panels.

Furthermore, such removal constitutes unproductive roof construction necessitated by the occasional need to remove panels due to misalignment.

In any construction project, time is of the essence. The faster a job can be completed the more valuable the job is to the customer and to the contractor providing the job. Due to the quality issues and productivity issues presented in constructing metal roofs by means of conventional, elongate, narrow roof panels, it would be desirable to improve metal roof construction in both quality and productivity.

SUMMARY OF THE INVENTION

The subject matter of the present invention concerns improvement in not only roof quality but also productivity in connection with constructing roofs with metal roof panels. The present invention contemplates at least one "center" panel mounted in a central portion of a given planar roof section. This center panel has matching, e.g., both female or both male, interlocking structures along its left and right edges. The center panel thereby presents two "working edges." A first series of conventional panels extend leftward and a second series of conventional panels extend rightward. A first person works rightward from the right edge of the center panel and a second person works leftward from the left edge of the center panel. Both workers apply "conventional" metal roof panels laterally outward to complete each sub-portion of the planar roof section. This immediately doubles productivity because two workers apply panels to a given roof section at one time. The center panel, often the longest panel in a given planar section of roof, can be better aligned and provide greater opportunity to align all roof panels in a given roof section. This reduces the possibility of having to remove mis-aligned roof panels during construction.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
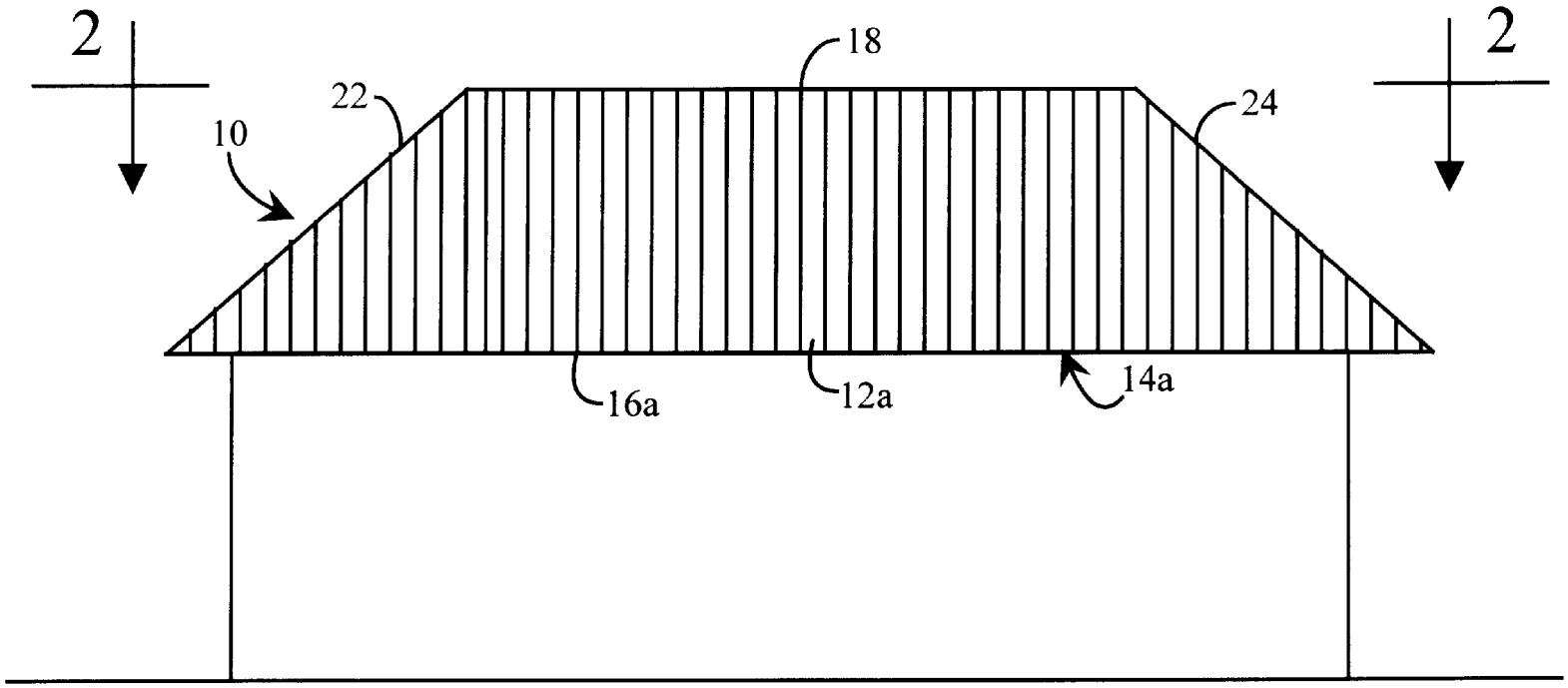
FIG. 1 illustrates schematically a building structure including a hip roof and roof system according to a preferred embodiment of the present invention.
Figure 2:
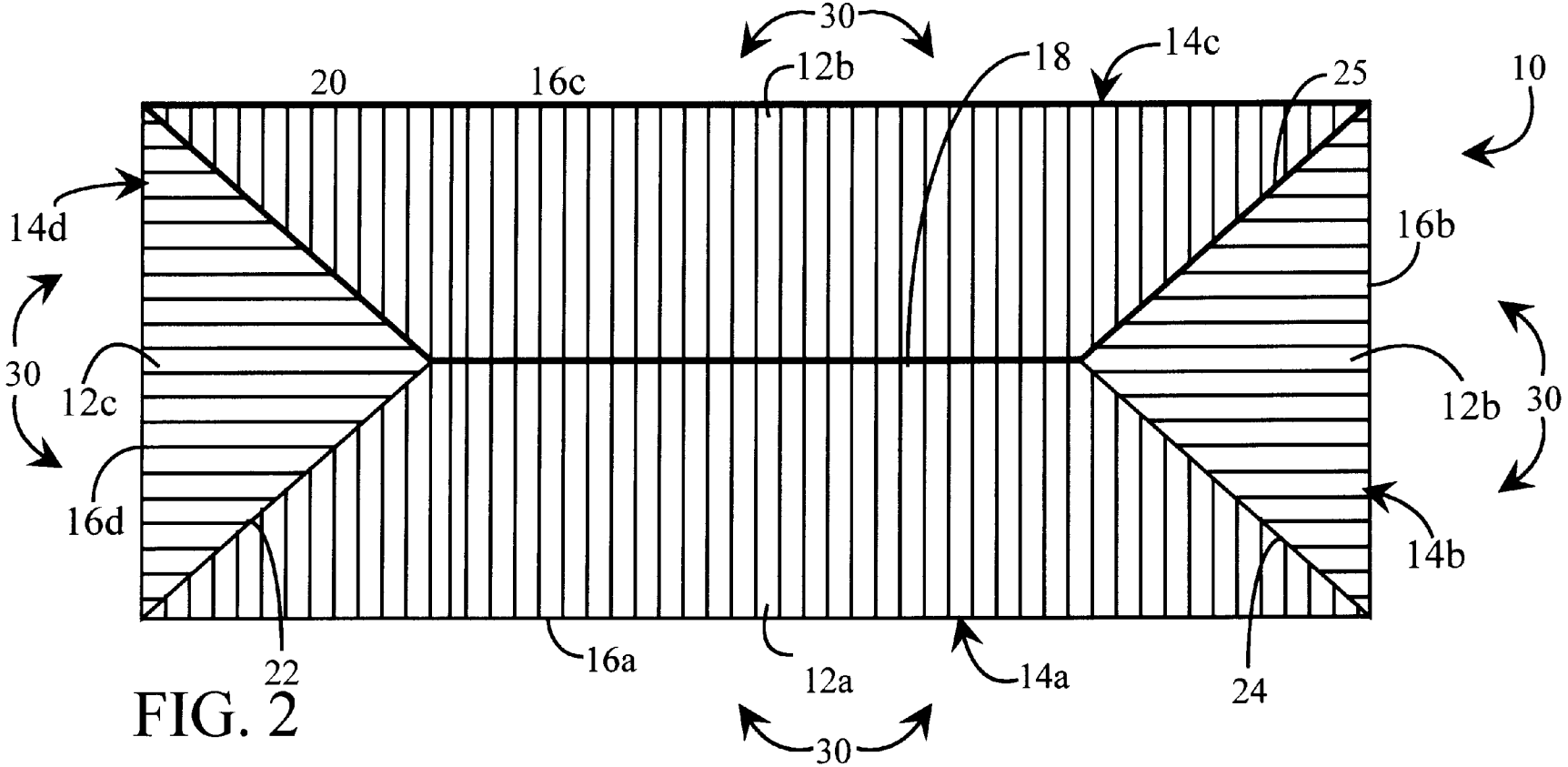
FIG. 2 illustrates the building structure and roof system of FIG. 1 as taken along lines 2—2 of FIG. 1.

With reference to FIGS. 1 and 2, a roof system 10 according to a preferred embodiment of the present invention makes use of at least one center panel 12 in each planar section of the roof system 10. FIGS. 1 and 2 illustrate, as an example, application of the present invention to a hip roof architecture. The hip roof architecture illustrated defines four planar sections 14, individually 14*a*–14*d*. Each planar section 14 has as its lower-most edge a gutter line 16, individually gutter lines 16*a*–16*d*. An upper ridge line 18 corresponds to the intersection between sections 14*a* and 14*c*. Similarly, ridge line 20 lies at the intersection of sections 14*c* and 14*d*; ridge line 22 at the intersection of sections 14*d* and 14*a*; ridge line 24 at the intersection of sections 14*a* and 14*b*; and ridge line 25 at the intersection of sections 14*b* and 14*c*.

For each planar roof section 14, at least one center panel 12 is placed first at a lateral midpoint in the section 14 and extending upward from the gutter line 16. For example, in section 14*a*, center panel 12*a* extends from gutter line 16*a* upward to ridge line 18. In section 14*b*, center panel 12 extends from gutter line 16*b* upward to the intersection of ridge lines 18, 24, and 25. In each case, the center panel 12 is best placed in a central position from left to right and as the longest roofing panel in that planar section 14. Center panels 12*c* and 12*d* are similarly first placed in sections 14*c* and 14*d*, respectively.

Figure 3:
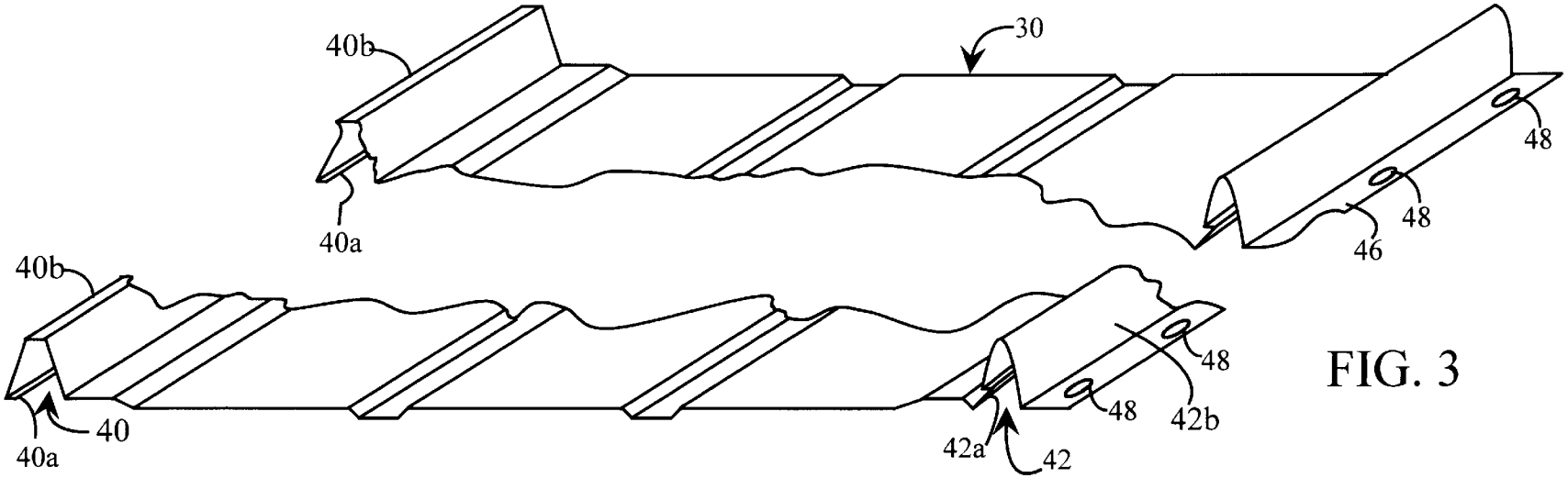
FIG. 3 illustrates a roof panel including complimentary interlocking structures at both sides of the panel.

A series of conventional panels 30 extend laterally outward from each centering panel 12 to complete coverage of a given planar section 14. FIG. 3 illustrates in perspective a conventional panel 30 and FIG. 4 illustrates in perspective a center panel 12.

In FIG. 3, a conventional panel 30 includes complimentary interlocking structures 40 and 42. In this regard, complimentary refers to an ability of one structure's shape to couple or lock to the other structure's shape. For example, conventional panel 30 includes a male interlocking structure 40 along its left edge (as viewed in FIG. 3) and a female interlocking structure 42 along its right edge (as viewed in FIG. 3). In this particular arrangement, male interlocking structure 40 presents an inward-facing shelf 40*a* and a tunnel structure 40*b*. Shelf 40*a* extends to the leftmost edge of panel 30. Female interlocking structure 42 includes a shelf 42*a* and a tunnel 42*b*. The rightmost edge of conventional panel 30 includes a planar shelf 46 and therealong apertures 48. A series of conventional panels 30 attach to a roof substrate in conventional fashion by attaching a given panel 30 by fasteners through apertures 48 and then placing the tunnel structure 40*b* of a next panel 30 over the tunnel structure 42*b* of the previously attached panel 30.

Figure 4:
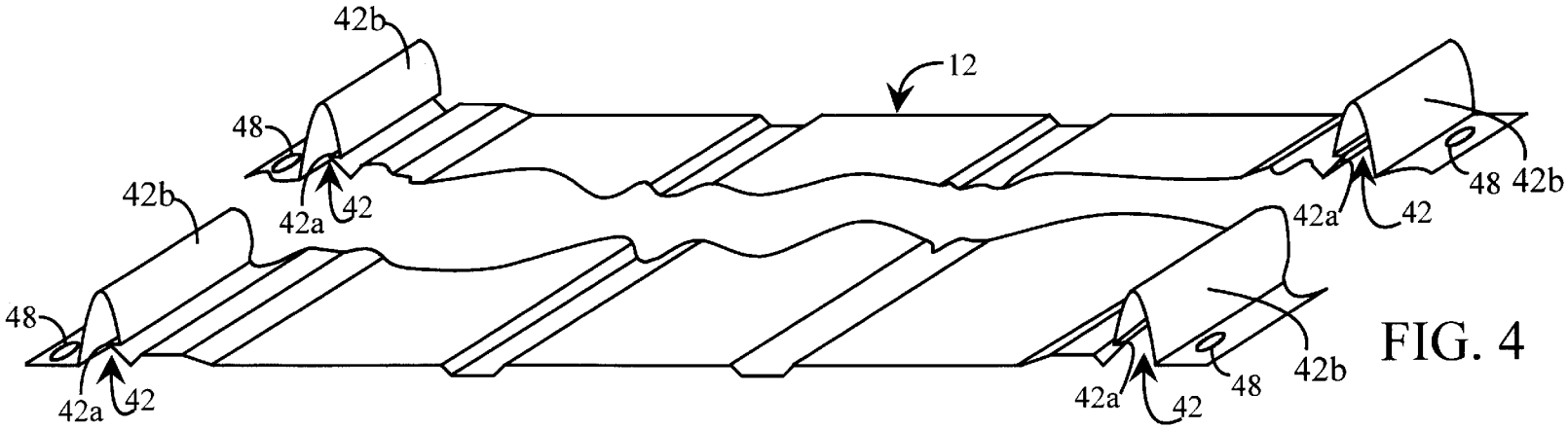
FIG. 4 illustrates a center panel according to the present invention and including matching interlocking structures along both edges of the panel.

In FIG. 4, center panel 12 differs from conventional panels 30 in that it has matching interlocking structures along both edges. In the particular example illustrated herein, a center panel 12 includes at its right edge and left edge a female interlocking structure 42 including a shelf 42*a* and a tunnel 42*b* as are present on conventional panels 30. Center panel 12 also includes a planar shelf 46 and apertures 48 along both edges for attachment to a roof substrate.

Conventional panels 30 may be flipped end-for-end without any change in function or appearance so long as a given series of panels 30 have the same orientation. In FIG. 3, conventional panel 30 is in a first orientation with its male interlocking structure 40 on the left side and female interlocking structure 42 on the right side in the view of FIG. 3. Flipping conventional panel 30 end-to-end relative to that illustrated in FIG. 3, presents at the right edge of conventional panel 30 the male interlocking structure 40 and at the left edge of conventional panel 30 the female interlocking structure 42. With a center panel 12 presenting on each edge a female interlocking structure 42, conventional panels 30 extending in series rightward therefrom each have on their left side a male interlocking structure 40. Conventional panels 30 extending in series leftward from a center panel 12 each have on their right side a male interlocking structure 40.

Figure 5:
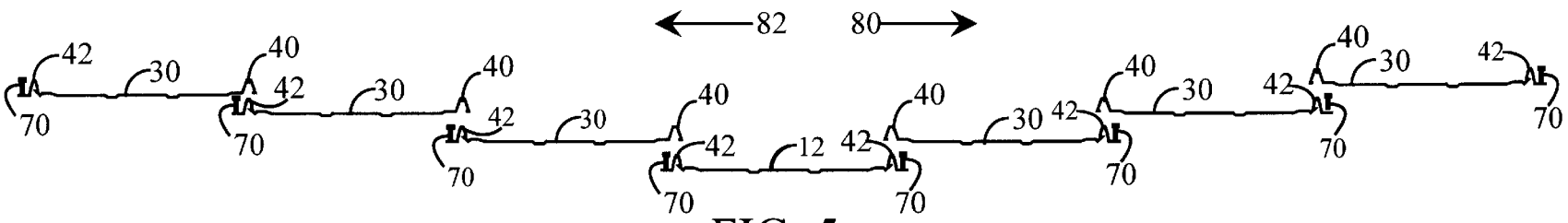
FIG. 5 illustrates an end view of a centering panel as illustrated in FIG. 4 and a series of conventional panels as illustrated in FIG. 3 extending laterally rightward and leftward therefrom to establish a roof system according to a preferred embodiment of the present invention.

FIG. 5 illustrates one possible sequence of construction contemplated under the present invention beginning with a center panel 12 attached, at a mid-portion of a planar roof section 14, along its left and right edges by placement of fasteners 70 through apertures 48 (not shown in FIG. 5). This ties down the center panel 12 at both edges to the roof substrate. A first series 80 of conventional panels 30 have a first orientation presenting at their left edge a male formation 40 and at their right edge a female formation 42. Once center panel 12 is fastened as described above, a first conventional panel 30 of series 80 may be attached to center panel 12 by engaging its male interlocking structure 40 with the female interlocking structure at the right edge of center panel 12. The rightmost edge of this first conventional panel 30 in series 80 may then be attached to the roof substrate by means of fasteners 70. Successive additional conventional panels 30 are then incorporated into series 80 by attaching a male interlocking structure 40 at each left edge thereof with a female interlocking structure 42 at a rightmost edge of a previously fastened conventional panel 30.

A second series 82 of conventional panels 30 may be attached to the roof concurrent with the process of attaching series 80. Conventional panel 30 members of series 82, however, have an opposite orientation, i.e., are flipped end-to-end relative to the orientation of conventional panels 30 of series 80. Accordingly, each conventional panel 30 of series 82 presents at its right edge a male interlocking structure 40 and at its left edge a female interlocking structure 42. A first conventional panel 30 in series 82 connects to center panel 12 by engaging its male interlocking structure 40 with the left female interlocking structure 42 of center panel 12. The left edge of this first conventional panel 30 of series 82 is then attached by fasteners 70 to the roof substrate. Successive members of series 82 are then attached to the roof substrate in series and in conventional fashion.

Because center panel 12 can be of maximum length for a given planar section, the overall pattern of conventional panels 30 resulting has a greater chance of being straight and uniform. In contrast, conventional methods of metal roof construction contemplate beginning with a short panel section at an extreme edge of the planar roof section and minor alignment errors propagate throughout the pattern often resulting in an undesirable appearance or need to replace due to initial, almost unavoidable in many cases, alignment errors.

Generally, each planar section includes at least one centering panel allowing construction laterally outward therefrom. It is possible under the present invention to begin with more than one centering panel to establish more than two "working edges", however, this would require accurate measurement to coordinate the positioning of panels as they approach a previously-installed panel. The preferred method is to place one centering panel in a given planar area and work outward in two directions therefrom. At minimum, this doubles productivity and also increases dramatically the chances of establishing a well aligned roof panel pattern.

It will be appreciated that the present invention is not restricted to the particular embodiment that has been described and illustrated, and that variations may be made therein without departing from the scope of the invention as found in the appended claims and equivalents thereof.

What is claimed is:

1. In a roof serving as the top outside covering of a building and including elongate panels interlocked at complimentary edge formations, said complimentary edge formations including a first formation and a second formation with an ability to interlock, an improvement comprising:

a center panel having matching edge formations, said matching edge formations corresponding to one of said first and second formations.

2. An improvement according to claim 1 wherein a first series of said elongate panels having a first orientation couple laterally outward from a first edge of said center panel.

3. An improvement according to claim 1 wherein a first series of said elongate panels having a first orientation couple to a first edge of said center panel and a second series of said elongate panels having a second orientation couple to a second edge of said center panel.

4. An improvement according to claim 1 wherein said elongate panels are metal panels.

5. An improvement according to claim 1 wherein said center panel is a metal panel.

6. An improvement according to claim 1 wherein said center panel attaches to said building along both edge formations and wherein said elongate panels attach along said one of said first and second formations.

7. An improvement according to claim 6 wherein said center panel when attached along both of said matching edge formations to said building structure, wherein a first series of said elongate panels when each attached to said building structure along one edge formation thereof and coupled in series one to the next laterally outward in a first direction from said center panel, and wherein a second series of said elongate panels when each attached to said building structure along one edge formation thereof and coupled in series one to the next laterally outward in a second direction from said center panel forms a roof structure substantially impervious to weather elements including at least one of precipitation and wind.

8. A roof system serving as the top outside covering of a building, said roof system comprising:

a set of panels, each panel of said set of panels having complimentary edge locking formations including a first formation at a first edge thereof and a second formation at a second edge thereof; and at least one center panel having matching edge locking formations corresponding to said first formation of each panel of said set of panels whereby a first series of said set of panels at a first orientation extends from said first edge of said center panel and a second series of said set of panels at a second orientation extends from said second edge of said center panel.

9. A system according to claim 8 wherein said at least one center panel is an elongate metal panel.

10. A system according to claim 8 wherein said set of panels comprises elongate metal panels.

11. A system according to claim 8 wherein said roof system rests on a given planar section of a roof.

12. A roof system according to claim 8 wherein said at least one center panel attaches to said building along each of said matching edge locking formations.

13. A roof system according to claim 12 wherein said at least one center panel when attached along both of said matching edge locking formations to said building structure, wherein a first series of said set of panels when each attached to said building structure along one edge formation thereof and coupled in series one to the next laterally outward in a first direction from said center panel, and wherein a second series of said set of panels when each attached to said building structure along one edge formation thereof and coupled in series one to the next laterally outward in a second direction from said center panel forms a roof structure substantially impervious to weather elements including at least one of precipitation and wind.

14. A method of roof construction to establish a top outside covering of a building comprising:

placing a center panel at a lateral mid-point on a given roof section, said center panel including matching edge locking formations at first and second edges thereof;

coupling a first series of panels laterally outward from said first edge of said center panel; and coupling a second series of panels laterally outward from said second edge of said center panel, members of said first and second series of panels each having complimentary edge locking formations, said complimentary edge locking formations including a first formation and a second formation, one of said first and second formations corresponding to said matching formations of said center panel, the other one of said first and second edge formations being adapted to interlock with said first one of said first and second locking edge formations.

15. A method according to claim 14 wherein said given roof section is a planar roof section.

16. A method of roof construction according to claim 14 wherein said placing a center panel step comprises attaching said center panel along each of said matching edge locking formations to said building and wherein said steps of coupling a first series of panels and of coupling a second series of panels each comprises attaching said other one of said first and second edge formations to said building.

17. A method according to claim 16 wherein said a roof structure resulting from said method of construction is substantially impervious to weather elements including at least one of precipitation and wind.

* * * * *